US009446501B2

(12) United States Patent
Obrachta et al.

(10) Patent No.: US 9,446,501 B2
(45) Date of Patent: Sep. 20, 2016

(54) METHOD AND APPARATUS FOR ABRASIVE STREAM PERFORATION

(71) Applicant: Spirit AeroSystems, Inc., Wichita, KS (US)

(72) Inventors: Kevin Lyle Obrachta, Wichita, KS (US); Mark Anthony Wadsworth, Sedan, KS (US)

(73) Assignee: Spirit AeroSystems, Inc., Wichita, KS (US)

( * ) Notice: Subject to any disclaimer, the term of this patent is extended or adjusted under 35 U.S.C. 154(b) by 22 days.

(21) Appl. No.: 14/587,482

(22) Filed: Dec. 31, 2014

(65) Prior Publication Data

US 2016/0184965 A1 Jun. 30, 2016

(51) Int. Cl.
*B24C 1/04* (2006.01)
*B24C 3/06* (2006.01)
*B24C 7/00* (2006.01)

(52) U.S. Cl.
CPC ..... *B24C 1/045* (2013.01); *B24C 3/06* (2013.01); *B24C 7/0046* (2013.01)

(58) Field of Classification Search
CPC ..... B24C 1/045; B24C 3/06; B24C 7/0046; Y10T 137/86815; Y10T 137/87571; Y10T 137/87676
USPC ..... 451/36–40, 75–102
See application file for complete search history.

(56) References Cited

U.S. PATENT DOCUMENTS 4,027,433 A * 6/1977 Hockett ..... B24C 3/00 239/281
4,255,906 A * 3/1981 Hockett ..... B24C 3/06 239/255
4,569,159 A * 2/1986 Wern ..... B24C 7/0046 222/630
4,612,737 A * 9/1986 Adee ..... G10K 11/172 451/29
4,646,485 A * 3/1987 Ashworth ..... B24C 9/006 451/101
4,773,189 A * 9/1988 MacMillan ..... B24C 1/086 451/88
4,787,178 A * 11/1988 Morgan ..... B26D 7/20 198/434
4,969,914 A * 11/1990 Ikegaya ..... B24B 7/241 451/160
5,081,799 A 1/1992 Kirschner et al.
5,105,588 A * 4/1992 Verley ..... B24C 5/04 451/102
5,445,220 A * 8/1995 Gurevich ..... B24C 1/045 166/223
5,605,492 A * 2/1997 Klingel ..... B24C 1/045 451/102
5,833,516 A * 11/1998 De Haas ..... B24C 1/04 451/29
6,004,190 A * 12/1999 Trampusch ..... B24C 1/003 451/38
6,273,790 B1 * 8/2001 Neese ..... B24C 1/003 451/38
6,315,648 B1 * 11/2001 Neer ..... B24C 3/062 451/75
6,524,171 B2 * 2/2003 Voutilainen ..... B24C 9/003 451/38
6,584,820 B1 * 7/2003 Benedict ..... B24C 1/06 451/38
6,607,175 B1 8/2003 Nguyen et al.
6,645,048 B1 * 11/2003 Linderholm ..... B24B 7/182 451/124

(Continued)

*Primary Examiner* — George Nguyen
(74) *Attorney, Agent, or Firm* — Hovey Williams LLP

(57) ABSTRACT

An abrasive stream perforation (ASP) system and method for forming a plurality of perforations through a composite part. The ASP system may include a compressed air source, a particulate source, a valve, nozzles, and a positioning device. The valve is actuatable between an open state and a closed state. The compressed air and particulate are simultaneously forced through the valve in its open state and then forced through the nozzles and against the surface of the composite part, forming the perforations through the composite part. The support frame maintains the nozzles in a spaced relationship to each other and a selected distance away from the composite part. The positioning device is fixed to the support frame and actuates the support frame relative to the surface of the composite part for proper positioning of the nozzles and the resulting perforations.

30 Claims, 7 Drawing Sheets

(56) References Cited

U.S. PATENT DOCUMENTS 7,125,322 B1 * 10/2006 Champaigne ..... B24C 1/045 451/89
7,186,167 B2 * 3/2007 Joslin ..... B24C 1/045 451/102
7,316,604 B1 * 1/2008 Burks ..... B24B 19/26 451/354
7,485,027 B2 * 2/2009 Miller ..... B24C 1/045 451/38
7,938,713 B2 * 5/2011 Trieb ..... B24C 1/045 239/101
8,262,436 B2 * 9/2012 De Gobbi ..... A47L 11/02 451/354
2009/0311944 A1 * 12/2009 Olsen ..... B24C 1/04 451/2
2010/0255759 A1 * 10/2010 Ohashi ..... B24C 9/003 451/38
2012/0021676 A1 * 1/2012 Schubert ..... B24C 1/045 451/38
2012/0276818 A1 * 11/2012 Cramer ..... B24C 1/045 451/38
2012/0315827 A1 * 12/2012 Edman ..... B23Q 1/032 451/38
2014/0087631 A1 * 3/2014 Raghavan ..... B24C 7/0023 451/38

* cited by examiner

METHOD AND APPARATUS FOR ABRASIVE STREAM PERFORATION

BACKGROUND

Parts made of composite materials are used in a variety of industries, including the aircraft industry. Some composite parts, such as inlets of aircraft nacelles, are perforated to aid in noise attenuation or dampening of aircraft engine noise. For example, some aircraft nacelles have approximately 800,000 holes per acoustic panel. These holes or perforations are formed into the composite parts using a variety of methods.

One method of perforation uses pin mats and rollers in a perforation process to mold holes into the composite part during cure. That is, an uncured composite skin is applied against a pinmat, similar to a bed of nails, and rollers press the composite skin toward the pinmat, forcing the pins into the composite part prior to cure. This method is costly and time consuming, requiring pin mat molding and contouring for specific composite part shapes, as well as a number of other steps that must be performed by hand by an operator. Furthermore, this method can create various defects on the composite part due to pin mat flaws, such as bent pins, missing pins, resin richness, seams, and a surface waviness anomaly associated with a transition from a perforated to a non-perforated area.

Another method of perforation involves a laser drilling process. However, laser drilling creates a heat-affected zone on the composite panel which can weaken the structural integrity of the composite part.

Yet another method of perforation involves perforating the composite part after cure using a mechanical drilling material removal process. However, this method involves a long set up and drilling time, and costly drill bits and other associated equipment. Furthermore, delamination forces may inadvertently separate layers of the composite part, damaging the integrity of the composite part.

Finally, another method involves perforating the composite part after cure using grit blasting while a perforated maskant (e.g., a stencil) is applied to a surface of the composite part to be perforated. The maskant may be made of rubber and protects the surface of the composite part and allows erosion of only the intended holes. However, this maskant is expensive and time consuming to produce, apply, and remove. Additionally, a large percentage of the abrasive particles thrown at the surface of the maskant are wasted in this grit blasting process, since the holes typically account for 14% or less of the total surface area of the composite part surface. Furthermore, the abrasive particles that rebound off the maskant can interfere with the effectiveness of an incoming abrasive particle stream. Finally, the amount of force used on the particles may be limited, so as not to destroy the maskant, but the less force used, the longer it will take to grit blast the perforations.

SUMMARY OF THE INVENTION

Embodiments of the present invention solve the above-mentioned problems and provide a distinct advance in the art of perforating composite parts. One embodiment of the invention provides a method of forming a plurality of perforations through a composite part. The method may include the steps of turning on an air or gas pressure source and opening a valve or a plurality of valves fluidly coupling the air or gas pressure source with a plurality of valves. The valve may be fluidly coupled to a particulate source holding particulate therein. Opening the valve may allow a flow from the air or gas pressure source to force the particulate through the plurality of nozzles. The nozzles may be directed at a surface of the composite part that is not covered by a maskant or stencil. The particulate forced against the surface of the composite part forms the holes or perforations therethrough.

Another embodiment of the invention provides a method of forming a plurality of perforations through a composite part. The method may include the steps of positioning an abrasive stream perforation (ASP) system against a surface of the composite part, turning on a compressed air source fluidly coupled with the ASP system, and opening a valve of the ASP system to allow the compressed air source to force particulate through a plurality of nozzles of the ASP system and against the surface of the composite part. The surface of the composite part is not covered by a maskant or stencil. The valve of the ASP system is fluidly coupled with both the compressed air source and a particulate source, and operates by way of a flexible diaphragm actuatable between an open state and a closed state via a change of pressure. The compressed air and particulate are simultaneously forced through the valve when the flexible diaphragm is in the open state. The step of opening the valve may include actuating the flexible diaphragm to the open state, such that a flow from the compressed air source forces the particulate through the plurality of nozzles directed at the surface of the composite part. The ASP system may also include a support frame supporting the nozzles, fluidly coupled with the valve, in a spaced relationship to each other and a selected distance away from the composite part. The support frame may include at least one contact element contacting the surface of the composite part via the positioning step above.

Yet another embodiment of the invention provides an abrasive stream perforation (ASP) system for forming a plurality of perforations through a composite part. The ASP system may include a compressed air source, a particulate source, a valve, a plurality of nozzles fluidly coupled to the compressed air source and the particulate source via the valve, a support frame, and a positioning device. The compressed air source may provide a stream of forced gas or air to the valve, while the particulate source may provide a plurality of particulate to the valve. The valve may be actuatable between an open state and a closed state. The stream of forced gas or air and the particulate may be simultaneously forced through the valve in the open state. When the nozzles are directed toward a surface of the composite part and the valve is in the open state, the particulate is forced through the nozzles and against the surface of the composite part. The support frame may support the nozzles in a spaced relationship to each other and a selected distance away from the composite part. The positioning device may be fixed to the support frame and may actuate the support frame, properly positioning and repositioning the nozzles to create perforations at predetermined locations throughout the surface of the composite part.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the current invention are described in detail below with reference to the attached drawing figures, wherein.

Figure 1:
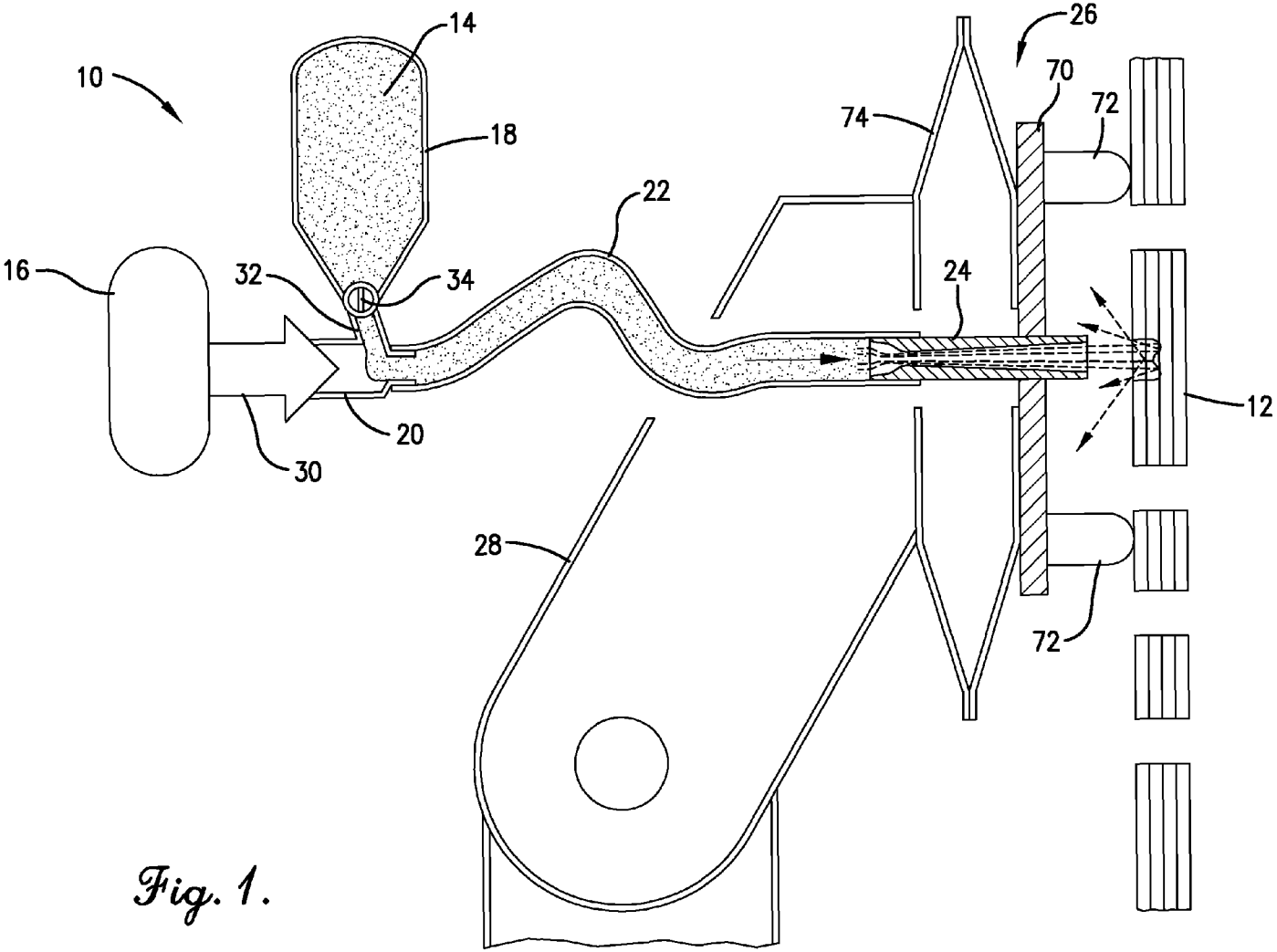
FIG. 1 is a schematic view of an abrasive stream perforation (ASP) system constructed according to embodiments of the present invention.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Figure 2:
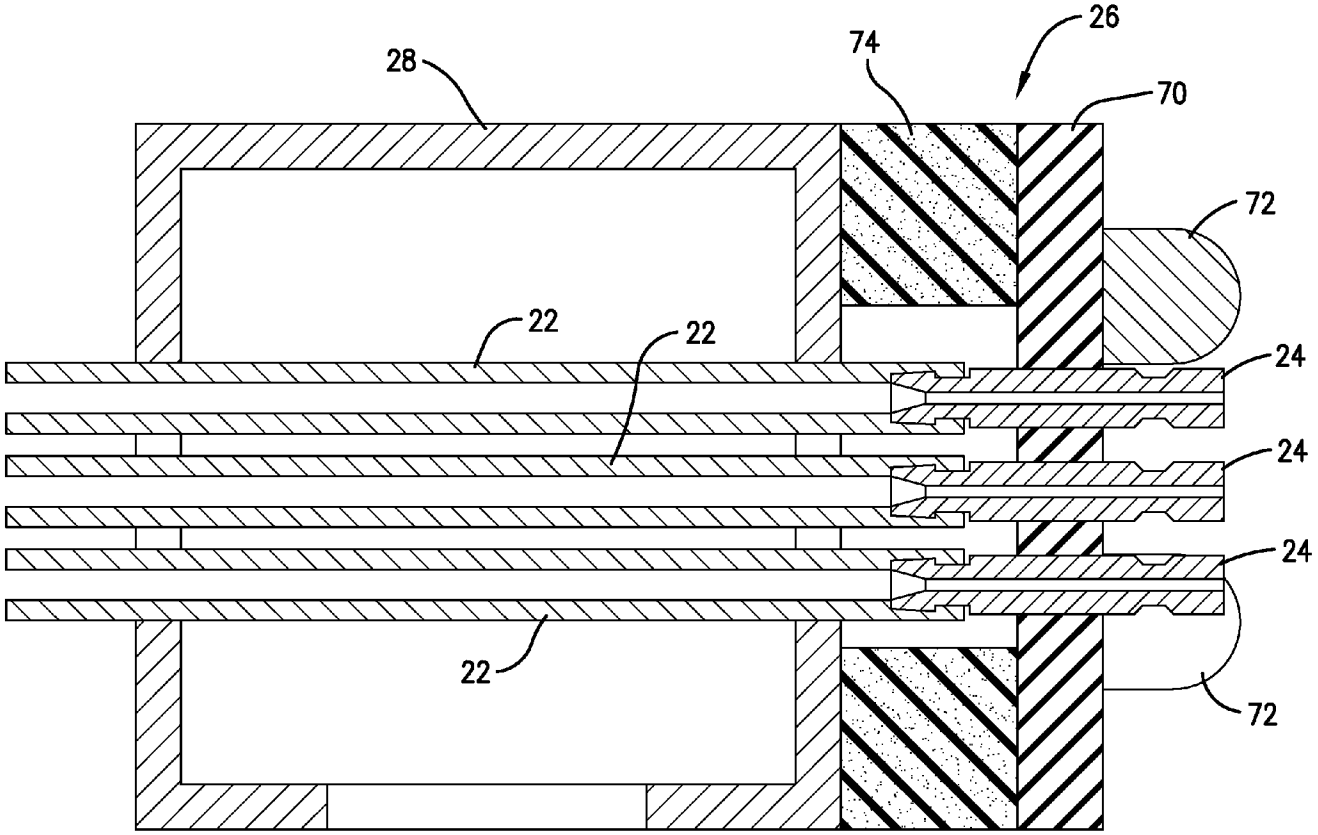
FIG. 2 is a cross-sectional view of nozzles and a support frame of the ASP system.

An abrasive stream perforation (ASP) system 10, constructed in accordance with embodiments of the present invention, is shown in FIGS. 1-6. Embodiments of the invention are configured for forming a plurality of holes or perforations into a composite part 12, such as an inlet of an aircraft nacelle, a skin of a sandwich panel, or any other cured or partially cured composite parts, by blasting multiple streams of particulate 14 simultaneously at the composite part 12. The particulate 14 may be any solid particles, abrasives, and the like, such as sand, aluminum oxide, garnet, grit, etc. The ASP system 10 may comprise a compressed air source 16, a particulate source 18, at least one valve 20, flow conduits 22, a plurality of nozzles 24, a support frame 26, and a positioning device 28, as illustrated in FIGS. 1 and 2.

The composite part 12 may be formed of composite material, as is known in the art of aerospace manufacturing, and may include a reinforcement material and a matrix material. Examples of composite material that may be used with the present invention include, but are not limited to, fiber materials such as carbon fiber, boron fiber, fiberglass, aramid fiber, ceramic fiber, and the like. In some embodiments of the invention, the composite part 12 may be composed of fiber-based reinforcement materials existing in one of the following forms—either preimpregnated (prepreg) in which the fiber may be coated with a matrix material that is uncured, such as uncured resin, or unenhanced (dry) with no additives to the fiber. The matrix material may include resins, polymers, epoxies, and the like, among others. The composite part 12 may specifically include one or more plies of any cured or partially cured composite material. In some embodiments of the invention, at least portions of the composite part 12 may include skin laminate, as known in the art of aerospace manufacturing.

The compressed air source 16 may be any source of compressed air, gas, or the like. For example, the compressed air source 16 may be an air compressor having an outlet 30 fluidly coupled with the valve 20 and/or the particulate source 18. Additionally or alternatively, the compressed air source 16 may be a blower or other apparatus configured for forcing air and/or particulate through flow conduits, valves, and nozzles. In some embodiments of the invention, the particulate source 18 and the compressed air source 16 may be combined in a single apparatus configured for blasting the particulate 14 out of an outlet thereof.

The particulate source 18 may be any apparatus configured for storing and/or delivering the particulate 14 to the compressed air source 16, valve 20, and/or nozzles 24. In some embodiments of the invention, the particulate source 18 may be a container having an outlet 32 fluidly coupled with the valve 20 and/or the compressed air source 16. The outlet 32 may be a narrow opening at the bottom of the container, and the container may have a funnel-shaped portion leading to the outlet 32. In some embodiments of the invention, a particulate flow device 34 may be located in or just outward of the outlet 32 and may be configured to be manually or automatically manipulated between an open position in which the particulate 14 may flow out from the particulate source 18 and a closed configuration in which the particulate 14 is prevented from exiting through the outlet 32 of the particulate source 18.

The compressed air source 16 and the particulate source 18 described herein are merely exemplary. Other compressed air sources and particulate sources may be used without departing from the scope of the invention. For example, a vibratory feeding device may be employed to accurately meter the particulate 14, as disclosed in U.S. Pat. No. 4,708,534, incorporated by reference herein in its entirety. Any other type of particulate blasting equipment known in the art may be employed to meter and mix the particulate 14 into an air stream. For example, the particulate source 18 may be pressurized to force the particulate 14 into the compressed air source 16 or flow conduits 22 fluidly coupled thereto. Alternatively, the venturi effect may be employed to draw the particulate 14 from the unpressurized particulate source into a compressed air line or flow conduit.

The valve 20 may be fluidly coupled with the compressed air source 16 and the particulate source 18 and the nozzles 24, either directly and/or via the flow conduits 22. The valve 20 may be any valve known in the art and may be actuatable between a closed state and an open state. The compressed air or gas and/or the particulate 14 may be forced through the valve 20 in the open state, urging the particulate toward the nozzles 24. In some embodiments of the invention, there may be a plurality of valves fluidly coupled with one or more compressed air sources and one or more particulate sources.

Figure 3:
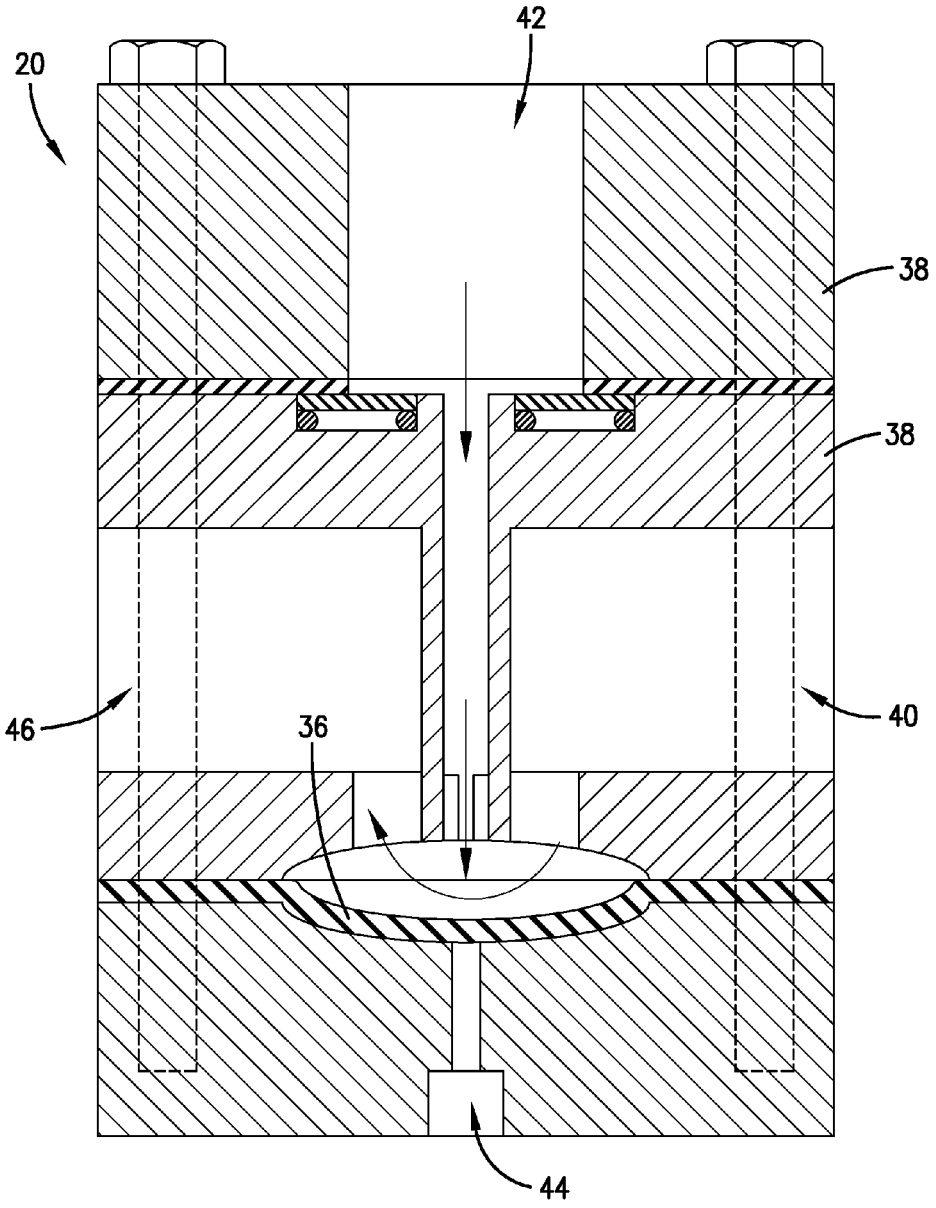
FIG. 3 is a schematic view of an assembled diaphragm valve of the ASP system of FIG. 1, illustrated in an open state.
Figure 4:
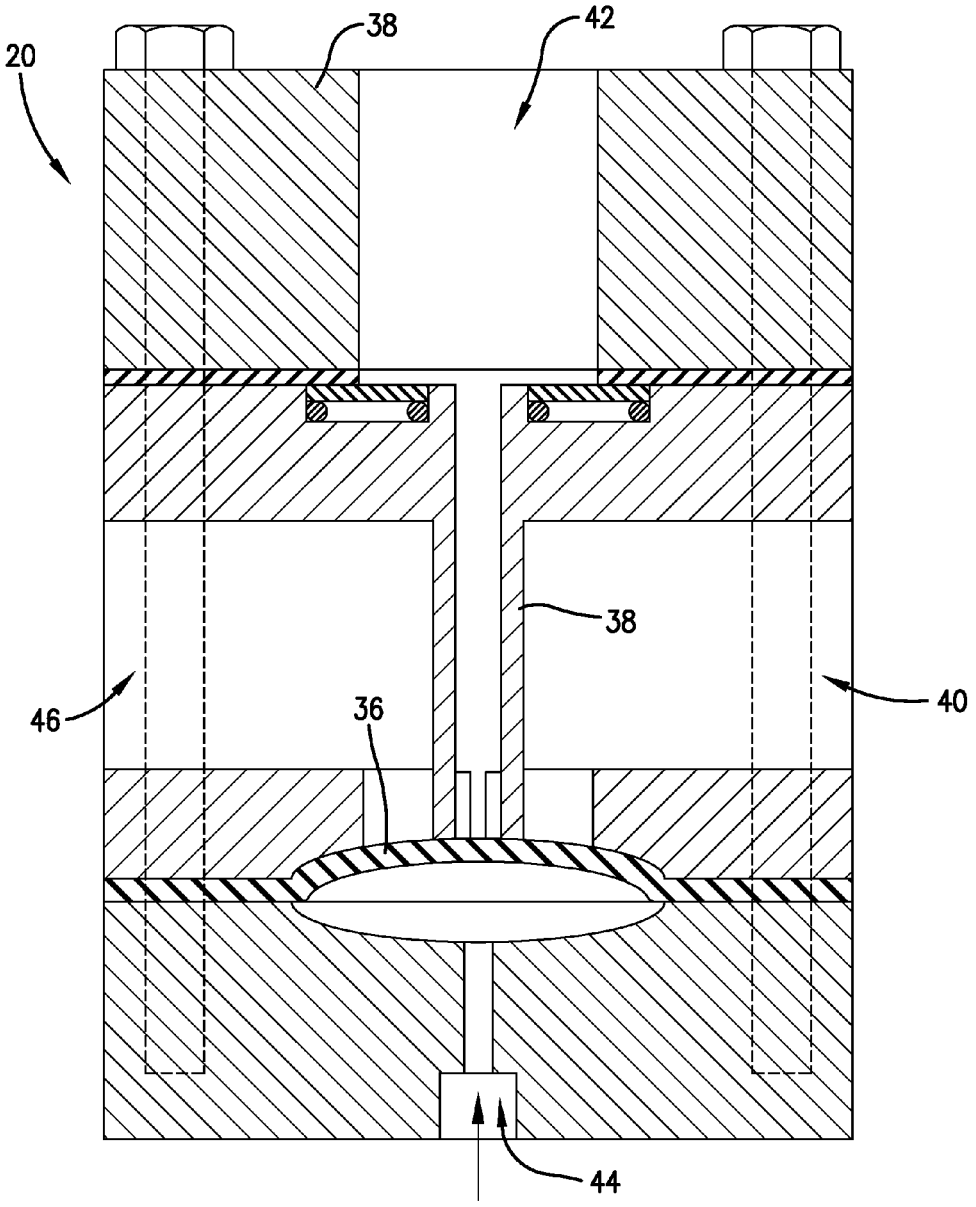
FIG. 4 is a schematic view of an assembled diaphragm valve of the ASP system of FIG. 1, illustrated in a closed state.

In one embodiment of the invention, as illustrated in FIGS. 3 and 4, the valve 20 (or valves) may be an assembled diaphragm valve having a flexible diaphragm 36 actuatable between the open state and the closed state based on a pressure differential applied to the flexible diaphragm 36. In addition to the flexible diaphragm 36, the assembled diaphragm valve may comprise a rigid hollow body 38 having a primary inlet 40 fluidly coupled to the compressed air source 16, a secondary inlet 42 fluidly coupled with the particulate source 18, a pilot air inlet 44 configured to actuate the flexible diaphragm 36 between the open and closed states, and a mixture outlet 46 fluidly coupled with both the primary inlet 40 and the secondary inlet 42 when the flexible diaphragm 36 is in the open state. In some embodiments of the invention, if additional types of particulate, fluid, or gas are to be mixed with the particulate 14, multiple secondary inlets may be provided in the assembled diaphragm valve, all fluidly coupled with the primary inlet 40 and the mixture outlet 46 via the opening of the flexible diaphragm 36.

The flexible diaphragm 36 may be made of any material generally used for inflatable or invertible bladders, such as an elastomer material or the like. Edges of the flexible bladder 36 may be sealed against and/or between portions of the rigid hollow body 38. When the flexible diaphragm 36 is in the closed state, both the primary and secondary inlets 40,42 are closed, as well as the mixture outlet 46. The flexible diaphragm 36 is configured such that, during actuation of the flexible diaphragm 36, the stream of particulate exiting the particulate source outlet 32 is pressed back toward the particulate source outlet 32, such that small amounts of the particulate 14 trapped between the flexible diaphragm 36 and the rigid hollow body 38 is enveloped by the flexible diaphragm 36.

The pilot air inlet 44 may be fluidly coupled with a fluid source, such as the compressed air source 16, or an alternative compressed air or gas source for applying a pressure differential to actuate the flexible diaphragm 36 into the closed state. When a force or air stream provided through the primary inlet 40 is greater than a force or airstream applied through the pilot air inlet 44, the flexible diaphragm 36 may actuate to the open state. In some embodiments of the invention, venting of air pressure built up in the pilot air inlet 44 may be enough to actuate the flexible diaphragm 36 into the open state. Additionally or alternatively, the pilot air inlet 44 may be connected to an apparatus configured to draw vacuum through the pilot air inlet 44 for actuating the flexible diaphragm 36 into the open state.

The flow conduits 22 may be flexible or rigid and may be made of any desired material known in the art. The flow conduits 22 may include a plurality of hollow tubes, passageways, hoses, or the like fluidly coupling any of the ASP system components described herein. For example, the flow conduits 22 may fluidly couple the compressed air source 16 and the particulate source 18 with the valve 20 and/or fluidly couple the valve 20 with the nozzles 24.

Figure 5:
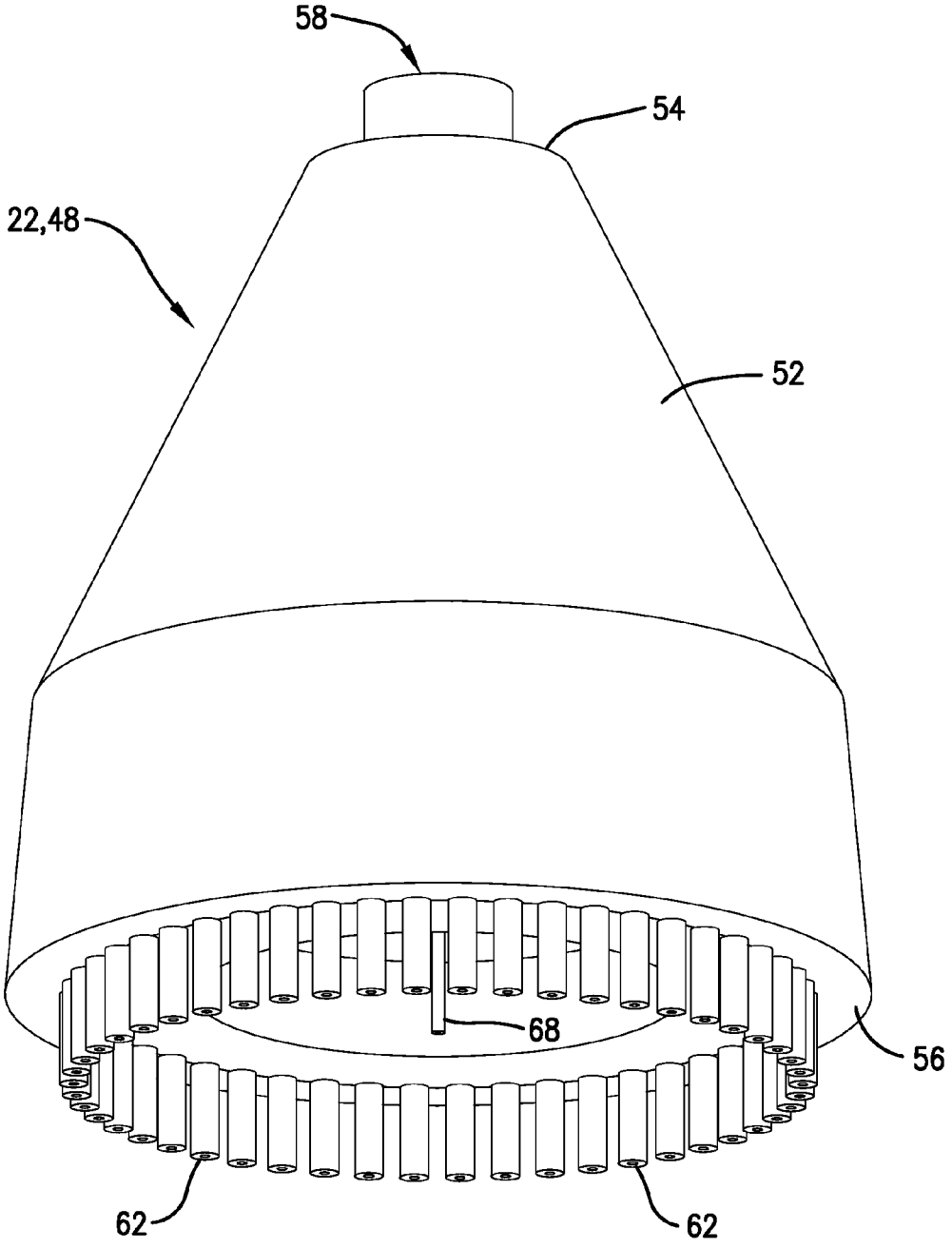
FIG. 5 is a perspective view of a flow divider of the ASP system of FIG. 1.
Figure 6:
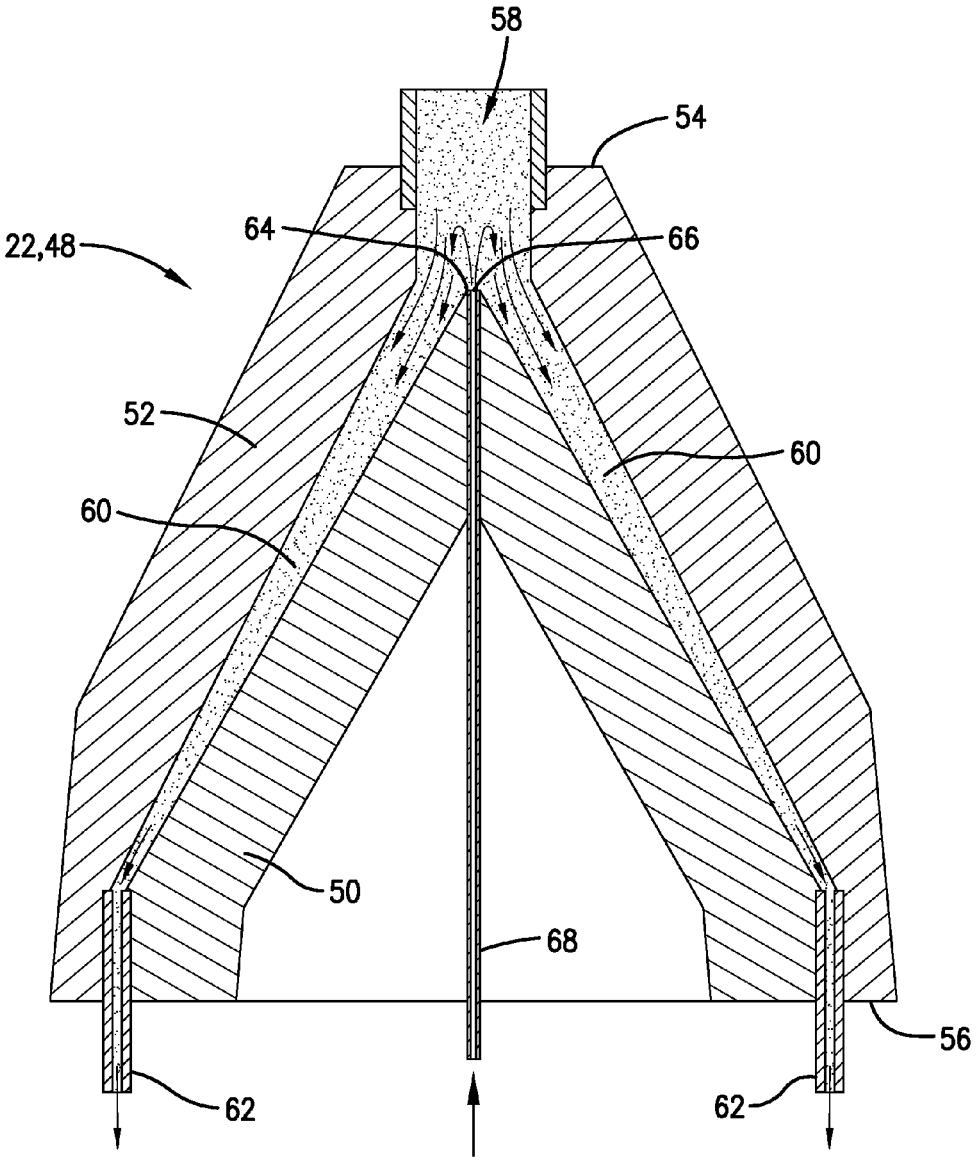
FIG. 6 is a cross-sectional view of the flow divider of FIG. 5.

In some embodiments of the invention, the flow conduits 22 may further comprise a flow divider 48, as illustrated in FIGS. 5 and 6. Specifically, two or more of the nozzles 24 may be fluidly coupled to the valve 20 by the flow divider 48. The flow divider 48 may have a conical shape having an inner cone wall 50 and an outer cone wall 52 extending between a narrowest end 54 and a widest end 56 opposite of the narrowest end 54. The outer cone wall 52 and/or the inner cone wall 50 may be made of an erosion resistant material, such as urethane elastomer. However, in some embodiments of the invention, the outer cone wall 52 may be made of a different material than the inner cone wall 50, with the inner cone wall 50 made of the erosion resistant material.

A flow divider inlet 58 may be axially formed through the outer cone wall 52 at the narrowest end 54 and fluidly coupled with one or more passageways 60 located between the inner and outer cone walls 50,52 and fluidly coupled to a plurality of flow divider outlets 62 at the widest end 56. For example, anywhere from two to 50 or more flow divider outlets 62 may be included at the widest end 56 of the flow divider 48. The flow divider outlets 62 may be fluidly coupled with the nozzles 24 described herein.

The passageways 60 between the flow divider inlet 58 and the flow divider outlets may maintain a substantially constant cross-sectional area from the flow divider inlet 58 to the flow divider outlets 62, so as to not accelerate the particulate-laden air or gas flowing therethrough. The cone shape of the flow divider 48 is configured such that the flow provided through the flow divider inlet 58 does not change directions abruptly. The gentle changes result in minimal separation of the particulate 14 from the air or gas, promoting even distribution thereof.

An apex 64 of the inner cone wall 50 may be hardened, providing durability against the particulate 14 forced against the apex 64 of the inner cone wall 50. Additionally or alternatively, a counter flow inlet 66 may be formed into the inner cone wall 50 at the narrowest end thereof (i.e., at the apex 64 thereof), and may be configured to receive a counter flow of gas or air therethrough. The counter flow may be forced through the counter flow inlet in a direction substantially opposite of a flow of the air and the particulate 14 entering the flow divider inlet 58, as illustrated in FIG. 6. This counter flow may deflect the particulate 14 flowing through the fluid divider inlet 58 before the particulate 14 impinges the inner cone wall 50. In some embodiments of the invention, the counter flow could be aimed slightly off-axis relative to the cone-shaped flow divider 48 to tune a distribution of the particulate 14 to compensate for wear and/or bias in flow entering through the flow divider inlet 58. Aiming of the counter flow may be accomplished, for example, by an angle at which the counter flow inlet 66 is formed. In some embodiments of the invention, a tube 68 may extend into the counter flow inlet 66 and may be configured to provide the counter flow therethrough.

The nozzles 24, as illustrated in FIGS. 1 and 2, may be fluidly coupled with the compressed air source 16 and the particulate source 18 via the valve 20, as illustrated in FIG. 1, such that the particulate 14 is forced through the nozzles 24 and against a surface of the composite part 12 when the valve 20 is in the open state. In some embodiments of the invention, the nozzles 24 may be de Laval nozzles (as in FIG. 1), rocket nozzles, hour-glass shaped nozzles, or the like. However, other shapes and types of nozzles 24 may be used without departing from the scope of the invention. The nozzles 24 may be sized and configured to correspond with a desired shape and area of the holes or perforations to be formed into the composite part 12. In some embodiments of the invention, the nozzles 24 may be arranged in an array, as illustrated in FIG. 2, and held a desired distance apart by the support frame 26. The configuration of the nozzle array may be selected based on a desired configuration of the holes or perforations relative to each other in the composite part 12. The desired configuration of the holes or perforations may be based on desired acoustic properties for the composite part 12. For example, the size and spacing of the nozzles 24 may be designed to achieve a specific percent of open area (POA), such as 6 to 18 POA.

The support frame 26, as illustrated in FIGS. 1 and 2, may be any frame configured for supporting the nozzles 24 in a spaced relationship to each other and at a selected distance away from the composite part 12. Specifically, the support frame 26 may comprise a floating portion 70 fixed to the nozzles 24, contact elements 72 extending from the floating portion 70, and a compliant portion 74 fixed to the floating portion 70. The nozzles 24 may extend through holes in the floating portion 70, as illustrated in FIG. 2, and/or be integrally formed through the floating portion 70. Ends of the nozzles 24 may extend a slightly shorter distance away from the floating portion 70 of the support frame 26 than ends of the contact elements 72.

In some embodiments of the invention, if the floating portion 70 is large and/or a contour of the composite part 12 to be perforated is tight, the floating portion 70 may be made of a flexible material and may bend to conform to the curvature of the surface of the composite part 12, thus maintaining each nozzle 24 substantially normal to the corresponding local contour of the composite part 12. In other embodiments of the invention, where the floating portion 70 is small and/or the contour of the composite part 12 to be perforated is gentle, the floating portion 70 may be made of a hard or rigid material and may hold the nozzles 24 parallel to one another without regard to local composite part contour. For example, in one embodiment of the invention, nine nozzles are located close together and maintained parallel to one another without regard to local composite part contour, and the floating portion 70 does not conform to local contours.

The contact elements 72 may be configured to contact the surface of the composite part 12 to maintain the selected distance between the nozzles 24 and the composite part 12. For example, the contact elements 72 may be carbide stand-offs protruding from a urethane floating portion 70 of the support frame 26. In some embodiments of the invention, the contact elements 72 may have rounded ends, to avoid causing any damage when moved laterally along the surface of the composite part 12.

The compliant portion 74 may comprise any material or apparatus configured to be compliant in a direction out-of-plane or perpendicular to the floating portion 70 and/or composite part 12, while remaining substantially rigid in a direction in-plane or parallel to the floating portion 70 and/or composite part 12. For example, the compliant portion 74 may be made of compliant rubber, foam (e.g., low density open celled foam as illustrated in FIG. 2), capable of out-of-plane compression toward and away from the floating portion 70 of the support frame 26 and the composite part 12, but remains substantially rigid to in-plane forces that are substantially perpendicular to this out-of-plane compression. In some embodiments of the invention, the compliant portion 74 may be made of or may comprise springs or other resilient members (such as a double-leaf spring or double diaphragm configuration illustrated in FIG. 1) configured to compress only in a direction toward the floating portion 70 of the support frame 26. The support frame 26 thus has in-plane rigidity for hole positioning accuracy, but out-of-plane compliance that ensures the nozzles' actual standoff distances and normality to local contours of the composite part 12 are set by the contact elements 72 extending from the floating portion 70 of the support frame 26, and not the positioning device 28. Therefore, inaccuracies of the positioning device 28 and geometric deviations of the composite part 12 from a theoretical design do not impact the standoff distance between the nozzles 24 and the composite part 12.

The positioning device 28 may be fixed to the support frame 26. For example, in some embodiments of the invention, the positioning device 28 may be fixed to the compliant portion 74 of the support frame 26. The positioning device 28 may be configured to actuate the support frame 26, properly positioning and repositioning the nozzles 24 to create perforations at predetermined locations throughout the surface of the composite part 12. For example, the positioning device 28 may be an apparatus or system configured for manual or operator-induced actuation thereof, to move the support frame 26 and nozzles 24 relative to the surface of the composite part 12 by a controlled, precise amount.

In some embodiments of the invention, as illustrated in FIG. 1, the positioning device 28 may be a robotic device (e.g., a robotic arm). The robotic device may be configured and/or programmed to automatically reposition the support frame 26 at predetermined times. For example, the robotic device may be manually or automatically actuated to move the support frame 26 to a starting point on the composite part 12. Then the robotic device may automatically reposition the support frame 26 on the surface of the composite part 12 by a predetermined amount when one or both of the following conditions are met: the valve 20 is in the closed state and at least one set of the perforations have been formed through the composite part 12. Additionally or alternatively, the robotic device may be communicably coupled with sensors detecting when the holes or perforations are formed. The robotic device may comprise conventional robotic components, circuits, microcontrollers, processors, actuators, memory storage devices, and any other robotic components known in the art. In some embodiments of the invention, operation of the valve 20 and the positioning device 28 may be fully or partially automated, with a central computer or controller commanding the timing of opening and closing the valve 20 and/or actuating the positioning device 28 based on pre-determined or preprogrammed time intervals.

In one alternative embodiment of the invention, the positioning device 28 may be fixed to the composite part 12 and configured to move the composite part relative to the support frame 26. In this embodiment, the compliant portion 74 of the support frame 26 may be fixed to a stationary object and movement of the positioning device 28 may actuate the composite part 12 to a desired location relative to the nozzles 24.

In use, a method of forming a plurality of perforations into the composite part 12 may include the steps of forcing the particulate 14 through the nozzles 24 toward the composite part 12 using compressed air or gas until the holes or perforations are formed through the composite part 12. This may involve opening the valve 20 to allow flow of the particulate 14 to the nozzles 24. The method may then include closing the valve 20 and actuating the nozzles 24 (via actuation of the support frame 26) to a different location relative to the composite part 12 to form subsequent perforations at the different location. Once in position, the valve 20 may be opened again, such that the particulate 14 may again flow through the nozzles 24. This process may be repeated as many times as required to create the desired number of perforations at the desired locations on the composite part 12.

Figure 7:
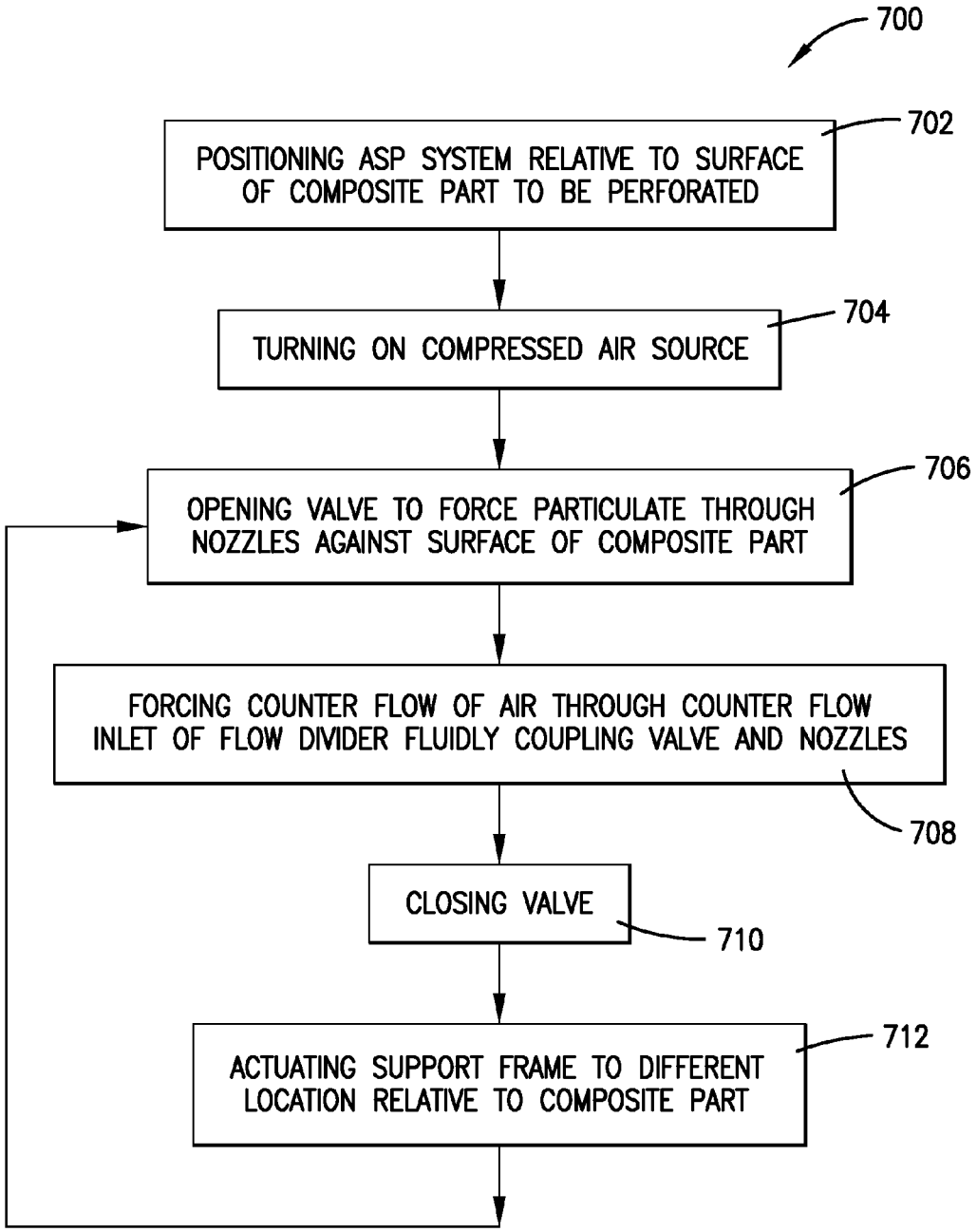
FIG. 7 is a flow chart illustrating a method of perforating a composite part in accordance with embodiments of the present invention.

Method steps for forming a plurality of perforations into the composite part 12 will now be described in more detail, in accordance with various embodiments of the present invention. The steps of the method 700 may be performed in the order as shown in FIG. 7, or they may be performed in a different order. Furthermore, some steps may be performed concurrently as opposed to sequentially. In addition, some steps may not be performed.

The method 700 may include a step of positioning the ASP system relative to the surface of the composite part 12 to be perforated, as depicted in block 702. That is, the support frame 26 and/or the contact elements of the support frame 26 may be located against the surface of the composite part 12. The positioning device 28 may actuate the support frame 26 to a desired area on the surface of the composite part 12 to be perforated. With the contact elements 72 positioned against the surface of the composite part 12, a proper distance between the nozzles 24 and the surface of the composite part 12 is maintained.

The method 700 may then comprise a step of turning on the compressed air source 16, as depicted in block 704. For example a power switch of the compressed air source 16 may be turned on or an electrical cord of the compressed air source 16 may be plugged in by the operator. This may force the particulate 14 to the valve 20. In some embodiments of the invention, the force from the compressed air source 16 may be varied to accommodate a desired type of particulate, a selected stand-off distance between the nozzles 24 and the composite part 12, and other such parameters affecting the perforation process.

Next, the method 700 may include a step of opening or otherwise regulating the valve 20, as depicted in block 706. With the compressed air source 16 turned on, opening the valve 20 forces the particulate 14 through the nozzles 24 fluidly coupled with the valve 20, such that the particulate 14 is forced against the surface of the composite part 12. In embodiments where the valve 20 is the assembled diaphragm valve described above, this step may include changing a pressure differential to actuate the flexible diaphragm 36 to the open state. Changing the pressure differential may merely involve stopping a flow of air or an opposing pressure being applied through the pilot air inlet 44. Additionally or alternatively, changing the pressure differential may include drawing vacuum via the pilot air inlet 44, as described above.

In some embodiments of the invention, the method 700 may include a step of forcing a counter flow of air through the counter flow inlet 66 of the flow divider 48, as depicted in block 708, thereby deflecting the particulate 14 flowing through the fluid divider inlet 58 before the particulate 14 impinges the inner cone wall 50. The counter flow of air may be provided via the tube 68 or another flow conduit extending between the compressed air source 16 and the counter flow inlet 66 or may alternatively be provided by any source of compressed air or gas.

Once the particulate 14 forced against the composite part 12 has eroded away enough composite material to form perforations all the way through the composite part 12, or has formed the perforations to be a desired depth into the composite part 12, the method 700 may include a step of closing the valve 20, as depicted in block 710. For example, closing the valve 20 may include creating a pressure differential to force the flexible diaphragm 36 into the closed state. Additionally or alternatively, the compressed air source 16 may be turned off to prevent the particulate 14 from being forced against the composite part 12 while the support frame 26 is relocating the nozzles 24.

The method 700 may then include a step of actuating the support frame 26 or portions of the support frame 26 to a different location relative to the composite part 12, as depicted in block 712, to form subsequent perforations at the different location of the composite part 12. This relocates the nozzles 24 relative to the composite part 12. As described above, this relocating may be performed by the positioning device 28 according to operator instructions or preprogrammed instructions executed by the positioning device 28. For example, the positioning device 28 may be programmed or otherwise configured to determine hole or perforation locations in two dimensions along the surface of the composite part 12 and to actuate the support frame 26 accordingly.

Next, the method 700 may return to step 706 above, opening the valve 20 again, such that the particulate 14 may flow through the nozzles 24, creating new holes or perforations into the composite part 12. This process may be repeated as many times as required to create the desired number of perforations at the desired locations on the composite part 12. Advantageously, the ASP system 10 and methods described above eliminates the need for a maskant and its associated costs and is more efficient than prior art methods.

Although the invention has been described with reference to the embodiments illustrated in the attached drawing figures, it is noted that equivalents may be employed and substitutions made herein without departing from the scope of the invention as recited in the claims. For example, although a single valve and compressed air source 16 are described herein for feeding a plurality of nozzles, a plurality of separate compressed air sources and/or valves may be used to independently feed each of the plurality of nozzles without departing from the scope of the invention. Additionally, although the method 700 above describes perforating a composite part, in some embodiments of the invention, other materials may also be perforated in this way. For example, certain hard-to-punch metals such as titanium or unreinforced ceramic materials, particularly those in areas proximate to a hot zone of an engine that would not be easily perforated by other methods, may be perforated using the ASP system 10 and the method 700 described herein.

Having thus described various embodiments of the invention, what is claimed as new and desired to be protected by Letters Patent includes the following:

1. A method of forming a plurality of perforations through a part, the method comprising:

fluidly coupling at least one valve to an air or gas pressure source;

fluidly coupling the at least one valve to at least one particulate source;

fluidly coupling the at least one valve to a plurality of nozzles;

regulating the at least one valve such that a flow from the air or gas pressure source urges particulate from the particulate source through the nozzles; and directing the nozzles at a surface of the part that is uncovered by a maskant or stencil, wherein the at least one valve is an assembled diaphragm valve having a flexible diaphragm actuatable between an open state and a closed state based on a change of pressure.

2. The method of claim 1, further comprising a step of: closing the at least one valve when the particulate has formed at least one perforation through the part.

3. The method of claim 1, wherein the assembled diaphragm valve has a primary inlet fluidly coupled to the air or gas pressure source, a secondary inlet fluidly coupled with the particulate source, a pilot air inlet configured to actuate the flexible diaphragm between the open and closed states, and a mixture outlet fluidly coupled with both the primary inlet and the secondary inlet when the flexible diaphragm is in the open state.

4. The method of claim 1, wherein the nozzles comprise at least two nozzles fluidly coupled to the at least one valve by a flow divider.

5. The method of claim 4, wherein the flow divider has a conical shape having an inner cone wall and an outer cone wall extending between a narrowest end and a widest end opposite of the narrowest end, wherein a flow divider inlet is axially formed through the outer cone wall at the narrowest end and fluidly coupled with one or more passageways located between the inner and outer cone walls and fluidly coupled to a plurality of flow divider outlets at the widest end.

6. The method of claim 5, further comprising forcing a counter flow of air through a counter flow inlet formed into the inner cone wall at the narrowest end while forcing the particulate through the fluid divider inlet, thereby deflecting the particulate flowing through the fluid divider inlet before the particulate impinges the inner cone wall.

7. The method of claim 1, wherein the nozzle includes at least one de Laval nozzle.

8. The method of claim 1, wherein the nozzles are supported a selected distance away from the part by a support frame.

9. The method of claim 8, wherein the support frame comprises: a floating portion fixed to the nozzles, contact elements extending from the floating portion and configured to maintain the selected distance between the nozzles and the composite part, and a compliant portion fixed to the floating portion and configured to be compliant in a direction out-of-plane or perpendicular to the floating portion while remaining substantially rigid in a direction in-plane or parallel to the floating portion.

10. The method of claim 9, further comprising a step of positioning or repositioning the nozzles relative to the part with a positioning device while the at least one valve is in the closed state, wherein the positioning device is fixed to the compliant portion of the support frame.

11. The method of claim 10, wherein the positioning device is a robotic device configured to determine perforation locations in two dimensions on the surface of the part and reposition the support frame accordingly.

12. A method of forming a plurality of perforations through a composite part, the method comprising:

positioning an abrasive stream perforation (ASP) system against a surface of the composite part, wherein the ASP system comprises:

at least one valve fluidly coupled with a compressed air source and a particulate source, wherein the at least one valve comprises a flexible diaphragm actuatable between an open state and a closed state by a change of pressure, wherein the compressed air and particulate are simultaneously forced through the at least one valve when the flexible diaphragm is in the open state, a plurality of nozzles fluidly coupled with the at least one valve, and a support frame supporting the nozzles in a spaced relationship to each other and a selected distance away from the composite part, wherein the support frame comprises at least one contact element contacting the surface of the composite part after the positioning step;

turning on the compressed air source; and opening the at least one valve by actuating the flexible diaphragm to the open state, such that a flow from the compressed air source forces the particulate through the plurality of nozzles directed at the surface of the composite part, wherein the surface of the composite part is not covered by a maskant or stencil.

13. The method of claim 12, wherein the valve has a primary inlet fluidly coupled to the air or gas pressure source, a secondary inlet fluidly coupled with a source of the particulate, a pilot air inlet configured to actuate the flexible diaphragm between the open and closed states, and a mixture outlet fluidly coupled with both the primary inlet and the secondary inlet when the flexible diaphragm is in the open state.

14. The method of claim 12, wherein the nozzle includes at least one de Laval nozzle.

15. The method of claim 12, wherein the support frame further comprises: a floating portion fixed to the nozzles and a compliant portion fixed to the floating portion and configured to be compliant in a direction out-of-plane or perpendicular to the floating portion while remaining substantially rigid in a direction in-plane or parallel to the floating portion, wherein the at least one contact element extends from the floating portion and maintains the selected distance between the nozzles and the composite part.

16. The method of claim 15, further comprising a step of positioning or repositioning the nozzles relative to the composite part with a positioning device while the flexible diaphragm is in the closed state, wherein the positioning device is fixed to the compliant portion of the support frame, wherein the positioning device is a robotic device configured to determine perforation locations in two dimensions on the surface of the composite part and reposition the support frame accordingly.

17. An abrasive stream perforation (ASP) system for forming a plurality of perforations through a composite part, the ASP system comprising:

a compressed air source configured for providing a stream of forced gas or air therefrom;

a particulate source configured for containing a plurality of particulate;

at least one valve fluidly coupled with the compressed air source and the particulate source and actuatable between an open state and a closed state, wherein at least one of the stream and the particulate are forced through the at least one valve in the open state, wherein the at least one valve is an assembled diaphragm valve having a flexible diaphragm actuatable between an open state and a closed state based on a change of pressure applied to the flexible diaphragm;

a plurality of nozzles fluidly coupled with the at least one valve, such that the particulate is forced through the nozzles and against a surface of the composite part when the at least one valve is in the open state and the nozzles are directed toward the composite part;

a support frame supporting the nozzles in a spaced relationship to each other and a selected distance away from the composite part; and a positioning device fixed to the support frame or fixable to the composite part, wherein the positioning device is configured to actuate the support frame or the composite part, properly positioning and repositioning the nozzles relative to the composite part to create perforations at predetermined locations throughout the surface of the composite part.

18. The system of claim 17, wherein the positioning device is a robotic device configured to automatically reposition the support frame on the surface of the composite part by a predetermined amount when the at least one valve is in the closed state and after one set of the perforations are formed through the composite part.

19. The system of claim 17, wherein the support frame comprises a floating portion fixed to the nozzles, contact elements extending from the floating portion and configured to maintain the selected distance between the nozzles and the composite part, and a compliant portion fixed to the floating portion and configured to be compliant in a direction out-of-plane or perpendicular to the floating portion while remaining substantially rigid in a direction in-plane or parallel to the floating portion.

20. The system of claim 17, wherein the assembled diaphragm valve has a primary inlet fluidly coupled to the compressed air source, a secondary inlet fluidly coupled with the particulate source, a pilot air inlet configured to actuate the flexible diaphragm between the open and closed states, and a mixture outlet fluidly coupled with both the primary inlet and the secondary inlet when the flexible diaphragm is in the open state, wherein the mixture outlet is also fluidly coupled with one or more of the plurality of nozzles.

21. The system of claim 17, wherein at least two of the plurality of nozzles are fluidly coupled to the at least one valve by a flow divider, wherein the flow divider has a conical shape having an inner cone wall and an outer cone wall extending between a narrowest end and a widest end opposite of the narrowest end, wherein a flow divider inlet is axially formed through the outer cone wall at the narrowest end and fluidly coupled with one or more passageways located between the inner and outer cone walls and fluidly coupled to a plurality of flow divider outlets at the widest end, wherein the at least one valve is fluidly coupled with the flow divider inlet and the at least two of the plurality of nozzles are fluidly coupled with the flow divider outlets.

22. The system of claim 21, wherein a counter flow inlet is formed into the inner cone wall at the narrowest end, wherein forcing a counter flow of air through the counter flow inlet deflects the particulate flowing through the fluid divider inlet before the particulate impinges the inner cone wall.

23. The method of claim 17, wherein the nozzle includes at least one de Laval nozzle.

24. A method of forming a perforation through a part, the method comprising:

positioning a contact element of a support frame against a surface of the part, wherein the support frame supports a nozzle a selected distance away from the composite part, wherein the support frame comprises:

a floating portion fixed to the nozzle, the contact elements extending from the floating portion, and a compliant portion fixed to the floating portion and compliant in a direction out-of-plane or perpendicular to the floating portion while remaining substantially rigid in a direction in-plane or parallel to the floating portion;

turning on an air or gas pressure source, wherein the air or gas pressure source is fluidly coupled to at least one valve, wherein the at least one valve is fluidly coupled to at least one particulate source holding particulate therein; and opening the at least one valve, such that a flow from the air or gas pressure source forces the particulate through the nozzle, wherein the nozzle is fluidly coupled with the at least one valve, wherein the nozzle is directed at a surface of the part, wherein the surface of the part is not covered by a maskant or stencil.

25. The method of claim 24, wherein the at least one valve is an assembled diaphragm valve having a flexible diaphragm actuatable between an open state and a closed state based on a change of pressure.

26. The method of claim 25, wherein the assembled diaphragm valve has a primary inlet fluidly coupled to the air or gas pressure source, a secondary inlet fluidly coupled with the particulate source, a pilot air inlet configured to actuate the flexible diaphragm between the open and closed states, and a mixture outlet fluidly coupled with both the primary inlet and the secondary inlet when the flexible diaphragm is in the open state.

27. The method of claim 24, wherein the nozzle includes at least one de Laval nozzle.

28. The method of claim 24, further comprising a step of positioning or repositioning the nozzle relative to the part with a positioning device fixed to the compliant portion of the support frame or to the part.

29. A method of forming a plurality of perforations through a part, the method comprising:

fluidly coupling at least one valve to an air or gas pressure source;

fluidly coupling the at least one valve to at least one particulate source;

fluidly coupling the at least one valve to a plurality of nozzles, wherein the nozzles comprise at least two nozzles fluidly coupled to the at least one valve by a flow divider, wherein the flow divider has a conical shape having an inner cone wall and an outer cone wall extending between a narrowest end and a widest end opposite of the narrowest end, wherein a flow divider inlet is axially formed through the outer cone wall at the narrowest end and fluidly coupled with one or more passageways located between the inner and outer cone walls and fluidly coupled to a plurality of flow divider outlets at the widest end;

regulating the at least one valve such that a flow from the air or gas pressure source urges particulate from the particulate source through the nozzles; and directing the nozzles at a surface of the part that is uncovered by a maskant or stencil.

30. A method of forming a plurality of perforations through a part, the method comprising:

fluidly coupling at least one valve to an air or gas pressure source;

fluidly coupling the at least one valve to at least one particulate source;

fluidly coupling the at least one valve to a plurality of nozzles, wherein the nozzles are supported a selected distance away from the part by a support frame, wherein the support frame comprises: a floating portion fixed to the nozzles, contact elements extending from the floating portion and configured to maintain the selected distance between the nozzles and the composite part, and a compliant portion fixed to the floating portion and configured to be compliant in a direction out-of-plane or perpendicular to the floating portion while remaining substantially rigid in a direction in-plane or parallel to the floating portion;

regulating the at least one valve such that a flow from the air or gas pressure source urges particulate from the particulate source through the nozzles; and directing the nozzles at a surface of the part that is uncovered by a maskant or stencil.

* * * * *